US012006688B2

(12) United States Patent
Leitch

(10) Patent No.: US 12,006,688 B2
(45) Date of Patent: Jun. 11, 2024

(54) METHOD AND APPARATUS FOR CREATING A SCORED HINGE IN A HIP OR RIDGE CAP SHINGLE

(71) Applicant: BMIC LLC, Dallas, TX (US)

(72) Inventor: Olan T. Leitch, Mt. Juliet, TN (US)

(73) Assignee: BMIC LLC, Dallas, TX (US)

( * ) Notice: Subject to any disclaimer, the term of this patent is extended or adjusted under 35 U.S.C. 154(b) by 78 days.

(21) Appl. No.: 17/477,645

(22) Filed: Sep. 17, 2021

(65) Prior Publication Data

US 2022/0081906 A1 Mar. 17, 2022

Related U.S. Application Data

(60) Provisional application No. 63/195,775, filed on Jun. 2, 2021, provisional application No. 63/079,657, filed on Sep. 17, 2020.

(51) Int. Cl.
*E04D 1/30* (2006.01)

(52) U.S. Cl.
CPC ..... *E04D 1/30* (2013.01); *E04D 2001/305* (2013.01)

(58) Field of Classification Search
CPC ..... E04D 1/30; E04D 2001/305
See application file for complete search history.

(56) References Cited

U.S. PATENT DOCUMENTS

| | | | | |
|---|---|---|---|---|
| 5,094,042 | A * | 3/1992 | Freborg | E04D 1/20 52/748.1 |
| 5,247,771 | A | 9/1993 | Poplin | |
| 5,319,898 | A * | 6/1994 | Freiborg | E04D 1/20 52/52 |
| 5,467,568 | A * | 11/1995 | Sieling | E04D 3/40 52/553 |
| 5,471,801 | A | 12/1995 | Kupczyk et al. | |
| 6,449,910 | B1 | 9/2002 | Budd | |
| 7,073,295 | B2 * | 7/2006 | Pressutti | E04D 1/30 52/745.19 |
| 7,921,606 | B2 * | 4/2011 | Quaranta | E04D 1/30 52/518 |
| 8,281,520 | B2 * | 10/2012 | Quaranta | E04D 1/30 52/518 |
| 9,650,787 | B2 * | 5/2017 | Montojo | E04D 1/30 |
| 10,787,814 | B2 * | 9/2020 | Duque | B32B 7/14 |
| 2010/0212246 | A1 * | 8/2010 | Grubka | E04D 1/20 156/252 |
| 2022/0081906 | A1 * | 3/2022 | Leitch | E04D 1/30 |

* cited by examiner

*Primary Examiner* — Andrew J Triggs
(74) *Attorney, Agent, or Firm* — Womble Bond Dickinson (US) LLP

(57) ABSTRACT

A cap shingle configured to be installed over a hip or ridge of a roof structure, and a method for creating scored hinge lines in hip and ridge cap shingles during manufacturing while minimizing the likelihood of breakage along the scored hinge lines due to lane tension are disclosed. The method includes forming score lines with a scoring cylinder across lanes of shingle material just before the lanes are cut into individual cap shingles with a pattern cutter. The scoring cylinder and pattern cutter are controlled so that the score lines are consistently applied along the centerlines of the cap shingles.

13 Claims, 9 Drawing Sheets

METHOD AND APPARATUS FOR CREATING A SCORED HINGE IN A HIP OR RIDGE CAP SHINGLE

CROSS-REFERENCE TO RELATED APPLICATIONS

The present Patent Application claims the benefit of U.S. Provisional Patent Application No. 63/079,657, filed Sep. 17, 2020, and U.S. Provisional Patent Application No. 63/195,775, filed Jun. 2, 2021.

INCORPORATION BY REFERENCE

The disclosures of U.S. Provisional Patent Application No. 63/079,657, filed Sep. 17, 2020, and U.S. Provisional Patent Application No. 63/195,775, filed Jun. 2, 2021, are specifically incorporated by reference herein as if set forth in its entirety.

TECHNICAL FIELD

This disclosure relates generally to roofing shingle manufacturing and more specifically to the manufacturing of cap shingles such as ridge and hip cap shingles.

BACKGROUND

Heavily laminated cap shingles offer increased durability and increased thickness, but generally are more difficult to bend. It is desirable that cap shingles such as ridge and hip cap shingles have a longitudinal central score line on the bottom of the shingle to allow the shingle to be bent more easily and precisely over a roof ridge or hip. Throughout this disclosure, the term "cap shingle" will be used to refer to any shingle product that is to be bent during installation. This includes, for instance, ridge cap shingles, hip cap shingles, and rake shingles to name a few.

Historically, forming a score line across a moving lane of shingle material during manufacture has presented a problem because of lane tension. Lane tension is necessary for shingle processing. This tension is present where a score will be applied, so scoring cannot be done at a location where the resulting line of weakness is likely to cause the shingle lane to break under lane tension. Generally, such breakage is most likely between the first pattern cutter where shingle stock is sliced into ribbons and the location where two ribbons of shingle material are laminated together to form a multi-layer lane of shingle material.

A need exists for a method and apparatus for creating score lines across a lane of shingle material in the process of manufacturing cap shingles with a minimum likelihood of breakage under lane tension. It is to the provision of such a method and apparatus that the present disclosure is primarily directed.

SUMMARY

Briefly described, a method and apparatus for forming a shingle having a scored hinge for application along a hip or ridge of a roof is provided. In embodiments, a separate scoring cylinder is added to a cap shingle manufacturing line immediately upstream of the terminal or "second" pattern cutter where a moving lane of shingle material is cut; for example, being cut into individual cap shingles, or into sets of cap shingles (e.g. sets of two, three or more cap shingles with perforations between the cap shingles). The scoring cylinder is synchronized with the second pattern cutter so that substantially precise control of the scoring process is possible while maintaining separate precise control of the pattern cutting process performed by the second pattern cutter. In embodiments, such as for laminated cap shingles, one or more score lines are applied after two or more ribbons of shingle material are laminated together, thus minimizing the possibility of tension induced lane breakage along applied score lines. In other embodiments, such as for single layer cap shingles, the score lines may only affect the back of the shingle material in a shingle lane, again minimizing the likelihood of lane breakage. The score lines define hinge or fold lines adapted to facilitate bending of the cap shingles during installation about a hip or ridge of a roof.

Aspects of the present disclosure include, without limitation, a method comprising moving a web of shingle material along a processing path; cutting the web of shingle material into ribbons of shingle material using a first cutter; laminating a plurality of ribbons together to form at least one lane of laminated shingle material; following the laminating step, forming at least one score line across the at least one lane of laminated shingle material; cutting the at least one lane of shingle material into cap shingles using a second cutter; and controlling the forming and cutting steps such that the at least one score line is positioned at a desired location along each of the cap shingles.

In embodiments of the method, the controlling step comprises controlling the forming and cutting steps such that the at least one score line is positioned along a center of each of the cap shingles.

In embodiments of the method, the step of forming at least one spaced score line comprises locating a scoring cylinder immediately upstream of the second cutter.

In other embodiments of the method, the controlling step comprises mechanically linking the scoring cylinder and the second cutter. In other embodiments, the controlling step comprises electronically linking the scoring cylinder and the second cutter. In some embodiments, the controlling step comprises driving the scoring cylinder with a servo motor and controlling the servo motor.

According to other aspects of the present disclosure, a method is provided, comprising moving a web of shingle material along a processing path; cutting the web of shingle material into at least one lane of shingle material having a top side and a bottom side; following the cutting step, forming spaced score lines across the bottom side of the at least one lane of shingle material; forming a slot along the bottom side of the at least one lane of shingle material, the slot configured to facilitate bending of a bottom layer of each shingle of a plurality of shingles; forming a machine direction slot configured to facilitate bending of a bottom layer of each of the shingles and forming a cross-machine direction slot configured to facilitate separation of one of the shingles from another shingle; following the forming steps, cutting the at least one lane of shingle material into shingles; and controlling the forming and cutting steps such that the score lines are positioned at desired locations across the shingles.

In embodiments of the method, the desired locations are midway between edges of the shingles. In some embodiments of the method, the at least one lane comprises at least two lanes, and the method further comprises laminating the at least two lanes of shingle material to form a lane of laminated shingle material prior to forming the spaced score lines.

In embodiments of the method, forming spaced score lines across the bottom side of the at least one lane of shingle material comprises forming at least a center score line extending along a centerline of the shingle material, the center score line defining a center fold line. In some embodiments, forming spaced score lines across the bottom side of the at least one lane of shingle material further comprises forming a plurality of additional score lines spaced along each side of the center score line and extending along the shingle material, wherein each of the additional score lines define additional fold lines.

In still other embodiments, of the method, cutting the at least one lane of shingle material into shingles comprises forming a sheet of multiple shingles with score lines along sides edges thereof configured to facilitate separation of the sheet of multiple shingles into individual shingles.

In some embodiments of the method, controlling the forming and cutting steps such that the score lines are positioned at desired locations across the shingles comprises controlling one or more servo motors corresponding to a first cutter, second cutter, third cutter, fourth cutter or combinations thereof, to thereby control cutting of the shingle material by the first cutter, second cutter, third cutter, and fourth cutter.

In embodiments, the method further comprises, prior to forming the slot, forming, by a third cutter, a machine direction slot to further facilitate bending of a bottom layer of each of the shingles and a cross-machine direction slot to further facilitate separation of one of the shingles from another shingle. In some embodiments, the third cutter includes one or more blades patterned to form the slot, the machine direction slot, and the cross-machine direction slot.

In embodiments, the method further comprises, prior to cutting the at least one lane of shingle material, applying a self-sealing material along a forward edge of a bottom layer, the self-sealing material configured to adhere each of the individual shingles to a headlap portion of an adjacent and underlying shingle.

In embodiments, the method further comprises, prior to cutting the at least one lane of shingle material, applying a self-sealing material along an upper surface of a top layer, the self-sealing material applied along the upper surface at a location adapted to adhere each of the shingles to an exposure portion of an adjacent and overlying shingle. In some embodiments, the method further comprises applying a releasable covering to the self-sealing material.

In embodiments of the method, forming at least one score line across the at least one lane of shingle material comprises forming at least a center score line extending along a centerline of the shingle material, the center score line defining a center fold line. In other embodiments of the method, forming at least one score line across the at least one lane of shingle material further comprises forming a plurality of additional score lines spaced along each side of the center score line and extending along the shingle material, wherein each of the additional score lines define additional fold lines.

According to another aspect of the disclosure, a shingle comprises a top layer comprising an exposure portion and a headlap portion; and a bottom layer adhered to the top layer, the bottom layer comprising a score line at least partially extending through the bottom layer, the score line formed along a center line of the shingle and beginning at a rear edge of the bottom layer, wherein the score line is configured to facilitate bending of the bottom layer; and wherein the score line extends through the bottom layer beginning at a forward edge of the bottom layer and ending toward the score line, and wherein the slot is configured to facilitate bending of the bottom layer.

In embodiments, the shingle comprises one or more individual cap shingles with score lines defined along side edges of at least one of the individual cap shingles and configured to enable separation of the individual cap shingles.

In some embodiments of the shingle, the bottom layer further comprises perforations or a score line at a juncture between each shingle of a multi-shingle sheet to allow for ease of separation of each shingle from another shingle.

In some embodiments of the shingle, the bottom layer further comprises a machine direction slot formed perpendicular to the slot, the machine direction slot to further facilitate bending of the bottom layer.

In some embodiments of the shingle, the bottom layer further comprises a cross-machine direction slot beginning at the forward edge of the bottom layer to the perforations or score line at the juncture.

In some embodiments of the shingle, the bottom layer further comprises an alignment feature disposed along the center line of the shingle and beginning at a rear edge of the bottom layer; and wherein, if the shingle includes such an alignment feature, the score line begins at an end of the alignment feature.

According to other aspects of the present disclosure, a roof structure is provided, comprising a hip or ridge; a plurality of cap shingles positioned along the hip or ridge, each of the one or more cap shingles comprising a top layer comprising an exposure portion and a headlap portion configured to connect to an adjacent cap shingle along the hip or ridge; and a bottom layer adhered to the top layer, the bottom layer comprising at least one score line at least partially extending through the bottom layer; and a slot cut at least partially through the bottom layer beginning at a forward edge of the bottom layer and ending toward the headlap portion, the slot configured to facilitate bending of the bottom layer as the cap shingle is positioned over the hip or ridge.

In embodiments of the roof structure, the at least one score line extends through the headlap portion from the slot to an upper edge of the cap shingle and is configured to further facilitate bending of the bottom layer as the cap shingle is fitted over the hip or ridge.

In some embodiments of the roof structure, the cap shingles comprise a sheet of cap shingles including multiple cap shingles; and the at least one score line comprises a plurality of score lines defined along the sheet of cap shingles and configured to facilitate separation of the multiple cap shingles into individual cap shingles in the field.

In some embodiments of the roof structure, the cap shingles further comprise a machine direction slot configured to facilitate bending of a bottom layer of each of the individual cap shingles; and a cross-machine direction slot configured to further facilitate separation of an individual cap shingle from another cap shingle.

In other aspects, a method is disclosed, comprising moving a web of shingle material along a processing path; cutting the web of shingle material into ribbons of shingle material using a first cutter; laminating a plurality of ribbons together to form at least one lane of laminated shingle material; and, following the laminating step, forming at least one score line across the at least one lane of laminated shingle material, the at least one score line formed such that the at least score line is positioned at a desired location along each of an individual cap shingle; cutting the at least one lane of shingle material into individual shingles or a plurality of shingles using a second cutter; and controlling the forming and cutting steps such that the at least one score line is positioned at a desired location along each of the shingles.

In embodiments of the method, the controlling step comprises controlling the forming and cutting steps such that the at least one score line is positioned along a center of each of the shingles.

In embodiments, the step of forming at least one score line comprises locating a scoring cylinder immediately upstream of the second cutter.

In some embodiments of the method, the controlling step comprises mechanically linking the scoring cylinder and the second cutter. In other embodiments, the controlling step comprises electronically linking the scoring cylinder and the second cutter. In further embodiments, the controlling step comprises driving the scoring cylinder with a servo motor and controlling the servo motor.

In embodiments, the at least one score line is formed such that the at least one score line is positioned along a centerline of each of the individual cap shingles. In another embodiment, the step of forming at least one spaced score line comprises locating a scoring cylinder immediately upstream of the second cutter. The scoring cylinder and the second cutter can be mechanically linked; and at least one of the scoring cylinder and/or the second cutter can be driven by a servo motor.

In some embodiments, the method includes, prior to forming at least one score line, forming a slot to further facilitate bending of a bottom layer of each of the individual shingles; and in embodiments, the method includes, forming, by a fourth cutter, a machine direction slot configured to further facilitate bending of a bottom layer of each of the individual shingles and a cross-machine direction slot to further facilitate separation of one of the individual shingles from another shingle.

In an embodiment, a controller is provided and included programming for controlling operation of the first cutter, second cutter, third cutter, and fourth cutter. The method can further include, prior to forming the slot, forming, by the third cutter, a machine direction slot to further facilitate bending of a bottom layer of each of the individual shingles and a cross-machine direction slot to further facilitate separation of one of the individual shingles from another shingle. In such embodiments, the third cutter includes one or more blades arranged in a pattern along the third cutter so as to form the slot, the machine direction slot, and/or the cross-machine direction slot.

In another embodiment, the method comprises applying a self-sealing material along a forward edge of a bottom layer, the self-sealing material for adhering each of the individual shingles to a headlap portion of an adjacent and underlying shingle. In embodiments, the method can include applying a releasable covering to the self-sealing material. In an embodiment, the forming of the at least one score lines across the at least one lane of shingle material comprises forming at least a center score line extending along a centerline of the shingle material, the center score line defining a center fold line. Further, the forming of the at least one score lines across the at least one lane of shingle material further can include forming a plurality of additional score lines spaced along each side of the center score line and extending along the shingle material, wherein each of the additional score lines define additional fold lines.

In another aspect, a cap shingle formed by embodiments of the methods of the present disclosure includes a top layer having an exposure portion and a headlap portion; a bottom layer adhered to the top layer; and including a score line at least partially extending through the bottom layer; wherein the slot can be formed along a center line of the cap shingle and beginning at a rear edge of the bottom layer, and will be configured to facilitate bending of the bottom layer. In embodiments, the bottom layer further comprises a slot cut from and through the bottom layer, and which can begin at a forward edge of the bottom layer and end at the score line, and which is configured to facilitate bending of the bottom layer.

In embodiments, the cap shingle can be formed with one or more individual cap shingles connected in series; and with the bottom layer thereof further comprising perforations or a score line at a juncture between each individual cap shingle. Such perforations or score line can allow for ease of separation of each individual cap shingle from another individual cap shingle. The bottom layer further can include a machine direction slot formed perpendicular to the slot and configured to facilitate bending of the bottom layer. The bottom layer can further include a cross-machine direction slot beginning at the forward edge of the bottom layer to the perforations or score line at the juncture. The bottom layer can further include an alignment feature disposed along the center line of the cap shingle and beginning at a rear edge of the bottom layer; and wherein, if the cap shingle includes such an alignment feature, the score line can begin at an end of the alignment feature.

In another aspect, a roofing structure for forming a roof comprises at least a hip or ridge and includes one or more cap shingles to fit and cover the hip or ridge. Each of the one or more cap shingles can comprise a top layer having an exposure portion and a headlap portion configured to connect to an adjacent cap shingle along the hip or ridge of the roof; and a bottom layer adhered to the top layer. The bottom layer includes a score line at least partially extending through the bottom layer. The score line can be formed along a center line of the cap shingle and beginning at a rear edge of the bottom layer and is configured to facilitate bending of the bottom layer as the cap shingle is fitted over the at least one hip or at least one ridge. The bottom layer further can include a slot at least partially extending through the bottom layer beginning at a forward edge of the bottom layer and ending at the score line. The slot can define a deformation absorbing mechanism configured to further facilitate bending of the bottom layer as the cap shingle is applied over the hip or ridge of the roof.

The apparatus and methods of forming shingles, for example but without limitation, embodiments of shingles configured for use along a hip or ridge of a roof, with scored hinges or fold lines, and features and/or embodiments thereof, according to the principles of the present disclosure will be better understood upon review of the detailed description set forth below taken in conjunction with the accompanying drawing figures, which are briefly described as follows.

Accordingly, embodiments of shingles, including, without limitation, cap shingles, and methods for forming the cap shingles that are directed to the above discussed and other needs are disclosed. The foregoing and other advantages and aspects of the embodiments of the present disclosure will become apparent and more readily appreciated from the following detailed description, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

Figure 1:
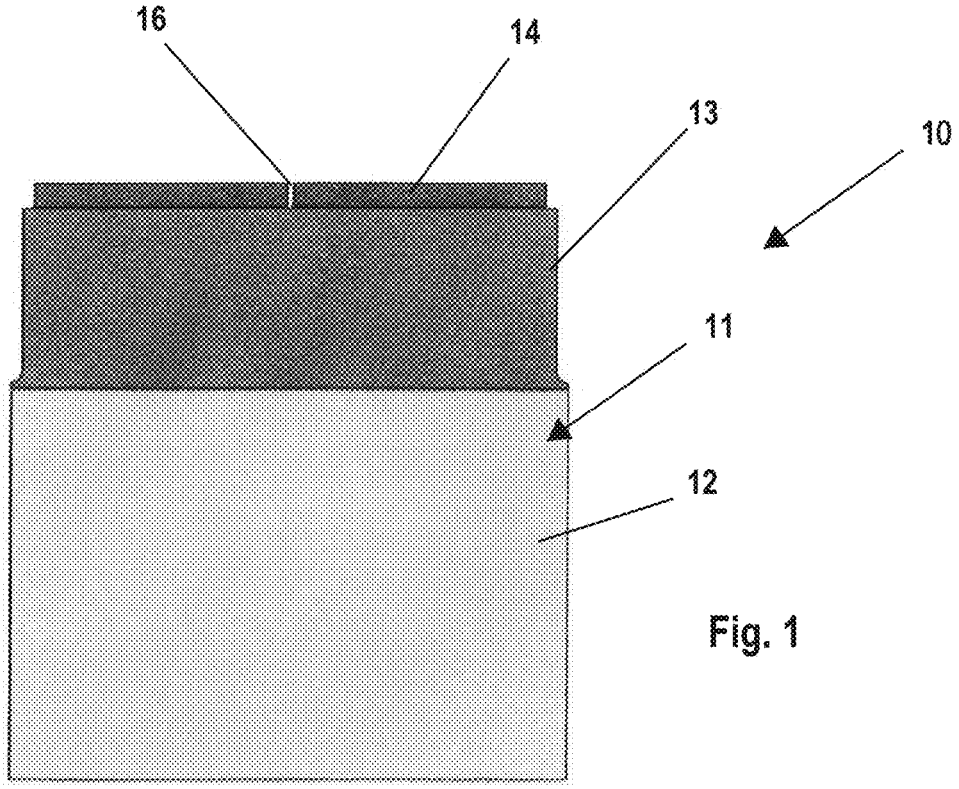
FIG. 1 is a top plan view showing one embodiment of a laminated cap shingle manufactured according to principles of the present disclosure.

Reference will now be made to the accompanying drawing figures, wherein like reference numerals indicate like parts throughout the views. FIG. 1 is a top plan view showing one example of a laminated cap shingle manufactured according to principles of the present disclosure. The laminated cap shingle 10 includes a top layer 11 of shingle material that has an exposure portion 12 and a headlap portion 13. A bottom layer 14 of shingle material (only the rear edge portion of which is visible in FIG. 1) is adhered to the top layer 11 to form the laminated cap shingle 10. The top layer 11 and bottom layer 14 may be adhered together along one or both of their edges, or may be otherwise laminated.

Figure 2:
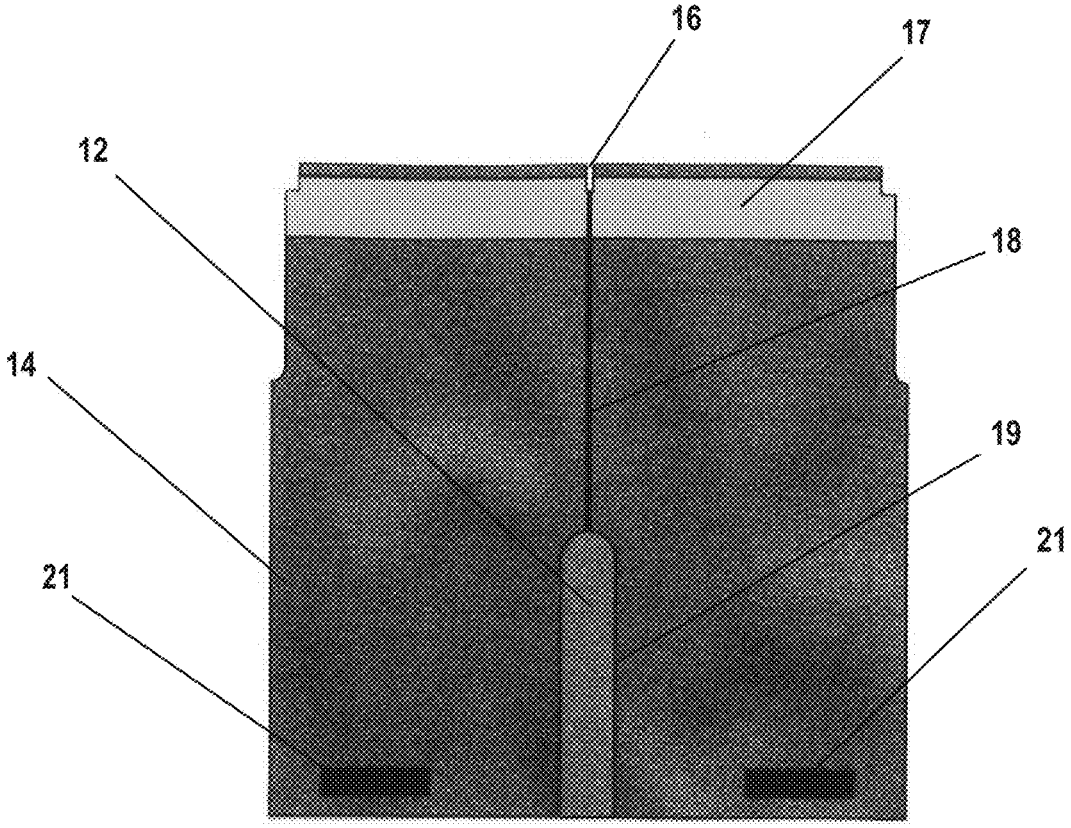
FIG. 2 is a bottom plan view of the laminated cap shingle of FIG. 1 showing a score line applied to the bottom layer of the shingle according to the present disclosure.

The bottom layer 14 in this example further is shown in FIG. 2 as having an alignment feature 16 formed in its rear edge portion adjacent a rear or distal edge thereof. This alignment feature 16 can be configured as a guide for facilitating alignment or location of the laminated cap shingles 10 with a ridge or hip of a roof during installation. It will, however, also be understood by those skilled in the art that while the alignment feature 16 is indicated as a slot or cut-out in FIGS. 1-2, other types of configurations of alignment features or guides also can be used, such as a score line, a recess, a depression or indentation, various markings, and/or other guide or indicating features. Still further, it will be understood by those skilled in the art that an alignment feature 16, such as a cut-out or slot, etc., is not necessarily required for installation of the laminated cap shingle 10, and thus, the laminated cap shingle 10 can be formed with or without such an alignment feature.

FIG. 2 is a view of the bottom layer 14 of the laminated cap shingle 10 of FIG. 1. The bottom layer 14 of the laminated cap shingle 10 is shown, with the alignment feature 16 formed along its rear or distal edge. In this example, the bottom layer 14 further is formed with a larger slot 19 extending from its forward or proximal edge rearward. When the top layer 11 and bottom layer 14 are bonded together along their side edges, the slot 19 can act as a deformation mechanism that is configured to enable deformation and flexing of the bottom layer such that the bottom layer can narrow as the laminated cap shingle 10 is bent around a hip or ridge of the roof to maintain the alignment of the side edges of the layers of the laminated cap shingle 10. This structure, however, is not a limitation of the present disclosure.

The exposure portion 12 of the top layer 11 is visible through the slot 19 in FIG. 2. A strip 17 of a releasable covering, such as a release tape or other, similar material can be applied along the rear edge of the bottom layer 14 to cover and protect a self-sealing strip or other adhesive application along the bottom layer 14 prior to installation. Further, self-sealing strips 21 can be applied along the front or forward edge of the bottom layer 14. In some embodiments, the self-sealing strip 21 can include adhesive dots or strips. The self-sealing strips 21 generally will be positioned or located along the bottom surface or bottom layer 14 and configured to adhere to an underlying laminated cap shingle without interfering with the function of the deformation mechanism formed by the slot 19. For example, the self-sealing strips 21 can be applied along the bottom layer 14 in positions near the front or forward edge of the bottom layer 14 to adhere the laminated cap shingle 10 to the headlap portion of an adjacent underlying cap shingle.

According to the present disclosure, a score line 18 extends longitudinally along the center of the bottom layer 14 from the alignment feature 16 to, in this example embodiment, the rear extent of the deformation mechanism formed by e.g. slot 19. Where there is no such slot 19, or in the case of single layer cap shingles, the score line 18 may extend completely to the front or forward edge of the cap shingle. The score line 18 can be formed along a center-line of the laminated cap shingle; and, as discussed above, the score line 18 can be configured to act as a partial hinge or fold line to ease and direct the bending of the cap shingle when it is applied over the ridge or hip of a roof.

In embodiments, the score line 18 can extend partially or fully through the thickness of the bottom layer 14 or the bottom layer 14 and/or top layer 11 of the laminated cap shingle. This provides an effective hinge line while minimizing the chances that formation of the score line will cause a breakage under line tension. For single layer cap shingles, the score line generally extends at least partially through the thickness of the single layer cap shingle, thus, the score line of a single layer cap shingle also can provide an effective hinge without affecting the top surface or the weathering function of the single layer cap shingle.

Figure 3:
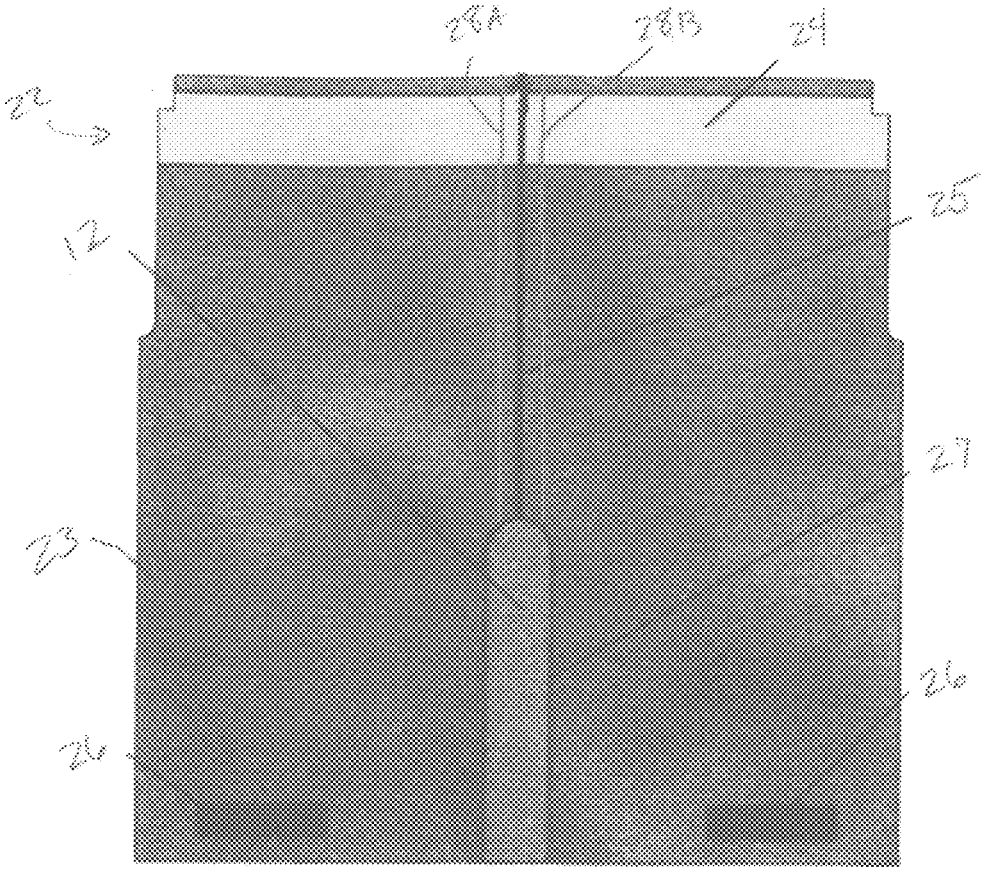
FIG. 3 is a bottom plan view of another embodiment of a laminated cap shingle according to the present disclosure.

FIG. 3 illustrates a bottom view of an additional embodiment of a shingle 22 formed according to the principles of the present disclosure. The shingle 22 can be formed as a laminated cap shingle having a bottom layer 23 adhered to a top layer of shingle material; for example, with the top layer and bottom layer 23 being adhered together along one or both of their side edges, or otherwise bonded or laminated to secure the top layer and bottom layer 23 together. The top layer also can include a headlap portion and an exposure portion 12 similar to the laminated cap shingle 10 shown in FIGS. 1-2.

As further illustrated in FIG. 3, in embodiments, a release strip or tape 24 can be applied to the cap shingle. The release tape will be applied to the cap shingle in a position such that it will cover a self-sealing adhesive material 26 applied to the cap shingle (for example, located along a rear edge or distal end of the bottom layer 23 or along the top layer adjacent the exposure portion of the cap shingle) and adapted to facilitate sealing of the cap shingle 22 to adjacent shingles when installed. The release tape 24 can be applied to the cap shingle in a subsequent processing step, and will be paired with the self-sealing adhesive material 26, such as during packaging of a plurality of shingles or sets of shingles in a stacked arrangement. By way of example, in embodiments, if the self-sealing adhesive material 26 is applied along the top layer of the cap shingle, the release tape will be applied at substantially the same position along the bottom layer of the cap shingle. The cap shingles thereafter can be stacked on top of each other to form a bundle, with the release tape along the bottom layer of each cap shingle of the bundle lining up with the self-sealing material 26 applied along the top layer of a cap shingle stacked there below.

In some embodiments, a self-sealing adhesive material 26 can be deposited or applied along the front or forward edge of the bottom layer 23 as dots or one or more strips of adhesive material. For example, a plurality of dots or strips of the self-sealing adhesive material 26 can be positioned or located adjacent an edge portion (e.g., the front or forward edge) of the bottom layer 23 as shown in FIG. 3. The dots or strips of self-sealing adhesive material will be arranged and/or configured to adhere the bottom layer 23 of the shingle 22 to an underlying cap shingle without interfering with the function of a deformation mechanism located along the bottom layer and configured to enable deformation of the bottom layer; for example, enabling the bottom layer to narrow as the shingle bends. Shown in FIG. 3, in one embodiment, the deformation mechanism is shown as an expanded slot 27 formed along the bottom layer 23, near a front or forward edge or proximal of the bottom layer 23 of the cap shingle 22. The self-sealing adhesive material strips 26 further will be configured to adhere the bottom layer 23 to the adjacent underlying cap shingle without interfering with the ability of the bottom and top layers of the shingle 22 to deform and/or adjust as the shingle 22 is bent about a hip or ridge of a roof during installation.

A score line 25 can be formed at least partially through the bottom layer 23, extending approximately along a centerline or central axis defined along the bottom layer of the cap shingle, and can form a central fold line in embodiments. The score line 25 will be configured to act as a partial hinge or central fold line to help facilitate bending of the cap shingle during installation. This score line 25 or central fold line provides an effective hinge line while minimizing the chances that formation of the score line 25 will cause a breakage under line tension. The expanded slot 27 further can be formed in the bottom layer 23, shown in FIG. 3 as extending from a terminal end of the score line 25 to the forward or proximal edge of the bottom layer 23 of the shingle 22. This expanded slot 27 can act, at least part, as a deformation mechanism for the laminated cap shingle, with the expanded slot 27 narrowing as the laminated cap shingle is bent around the hip or ridge of a roof to help maintain alignment of the side edges of the top layer and bottom layer 23 of the shingle 22.

In addition, an alignment feature 16 as shown in FIG. 2 above, may or may not be used/provided. Thus, while not shown in FIG. 3, such an alignment feature or other alignment or guiding device can be provided in some embodiments of the laminated cap shingle. Still further, the score line 25 can be configured in some embodiments to facilitate bending of the bottom layer 23 of the shingle 22 around the hip or ridge of a roof by itself. In other embodiments, additional score lines, indicated at 28A and 28B in FIG. 3, also can be defined or formed along the bottom layer 23 of shingle material, and can define or provide additional hinge or fold lines to the shingle 22.

For example, as shown in FIG. 3, a pair of spaced score lines 28A/28B can be formed along opposite sides of the score line 25 or central fold line. It will be understood, however, that the present disclosure is not to be limited to use of a particular number of score lines, such as a pair of substantially equal distantly spaced score lines. Thus, it will be understood that additional score lines, e.g. 4 or more parallel score lines, also can be formed in the bottom layer 23, with the score lines formed at selected spacings across the width of the bottom layer of the cap shingle.

In some embodiments, the score lines 28A/28B can be arranged on opposite sides of the score line or central fold line 25 at spacings of approximately ⅛"-1" apart. In other embodiments, the score lines can be spaced approximately ¼"-¾" apart, while in other embodiments, the score lines can be spaced approximately ⅜"-⅝" apart, and in still further embodiments, the score lines can be spaced ⅛"-½" apart. Greater or lesser spacings between score lines 28A/28B also can be utilized.

The spacing of the score lines across the bottom layer 23 further can be selected to define or provide a hinge of folding mechanism configured or adapted to function similar to a book binding, with a peak of a hip or ridge of a roof over which the shingle 22 is installed being received substantially along the score line 25 or central fold line between the spaced, parallel score lines 28A/28B. The additional score lines 28A/28B will help facilitate further bending of the bottom layer 23 of the shingle 22. For example, the score lines 28A/28B allow the side portions of the bottom layer 23 to further bend about the hip or ridge of the roof along which the shingle 22 is installed, providing increased flexibility of the hinge of the shingle 22 defined by the score line 25 or central fold line and additional score lines 28A/28B. This will help provide a closer engagement or fit between the cap shingle and the hip or ridge of the roof over which it is installed.

Figure 4A:
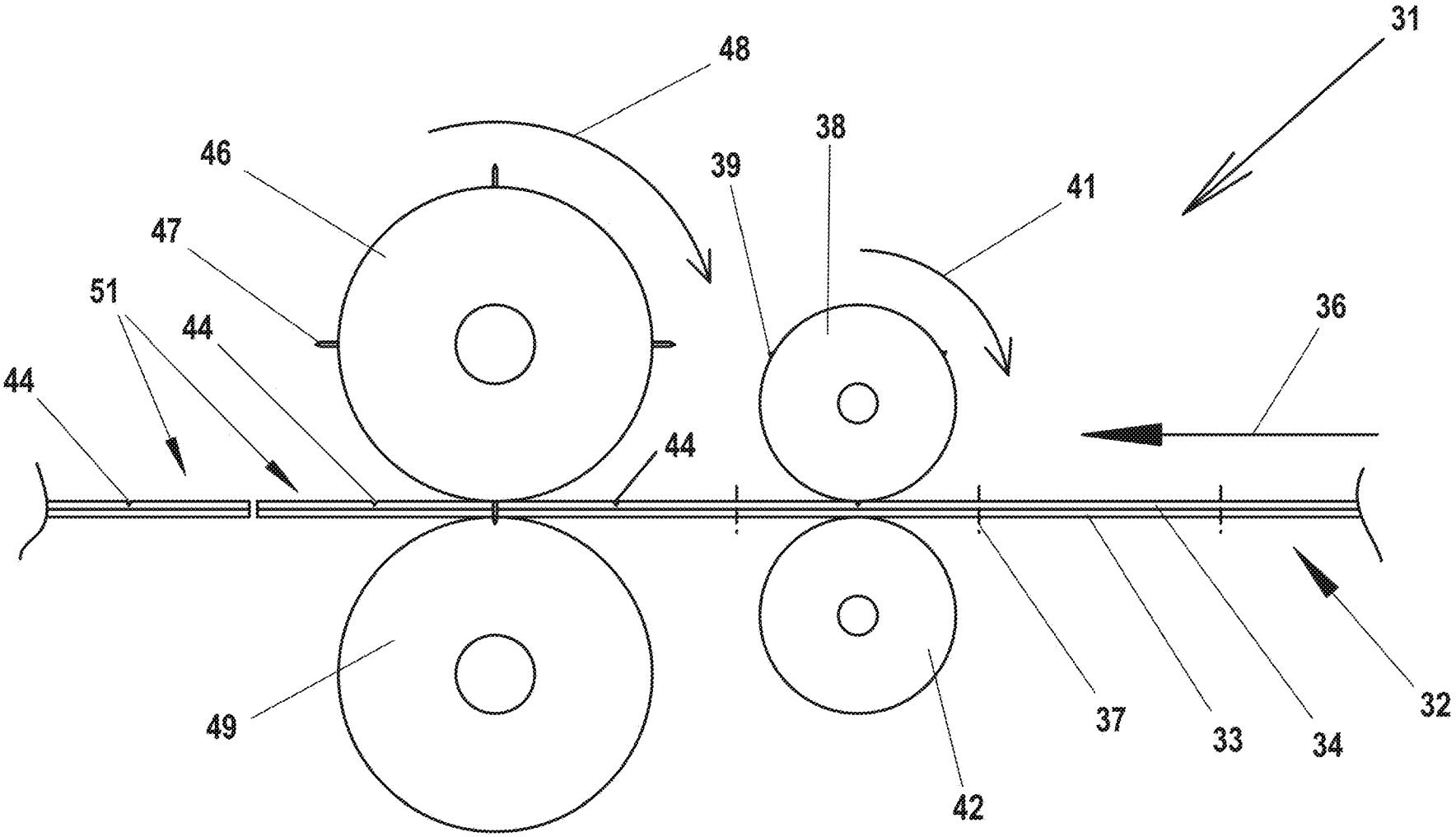
FIG. 4A is a simplified schematic view illustrating one embodiment of the method and apparatus of the present disclosure.
Figure 4B:
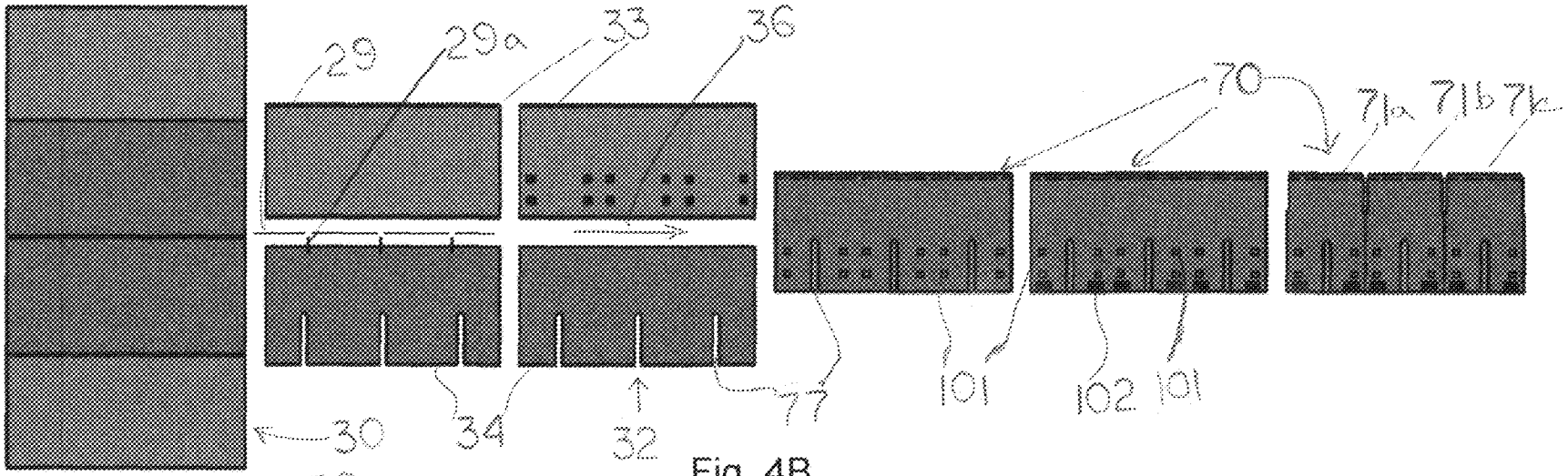
FIG. 4B is a schematic illustration of a process of forming a laminated cap shingle of FIGS. 1-3.

FIGS. 4A-4B illustrate in simplified schematic drawings an embodiment of a method and a processing line and an apparatus 31 (FIG. 4A) for forming a laminated cap shingle such as shown in FIGS. 1-3. FIG. 4A illustrates the apparatus 31, which in embodiments, can form a laminated cap shingle, including the formation of score line 18 and formation of expanded slot 27 (defining a deformation absorbing mechanism) in a cap shingle according to principles of the present disclosure. FIG. 4A depicts a section of a cap shingle manufacturing line near its terminal end. Here, a lane of laminated shingle material 32 moving in direction 36 is cut into individual cap shingles 51 by a terminal or second pattern cutter 46.

It will be understood that before reaching this section of the manufacturing line, a web of shingle material has already been sliced into ribbons and one ribbon 34 has been folded or otherwise positioned on and laminated to another ribbon 33 to form the lane of two-layer laminated shingle material. For example, as schematically illustrated in FIG. 4B, a sheet or web of shingle material 30 can be fed through an initial, upstream cutter (indicated at 29 in FIG. 4B) where the web of shingle material 30 is separated into ribbons 33/34, the ribbons 33/34 continuing along lane 32, along a processing path 36. An adhesive 35 is applied, e.g. in strips, dots, lines or other applications, to a first side 33A of ribbon 33, after which ribbon 34 is positioned over and adhered or laminated to ribbon 33. In one non-limiting embodiment as shown in FIGS. 4A-4B, after lamination of the ribbons, the bottom layer of the laminated shingle material (e.g., ribbon 34) faces upwardly. It will, however, be understood that, in other embodiments, the top layer of laminated shingle material (e.g. ribbon 33) can be oriented facing upwardly.

Phantom lines 37 (FIG. 4A) indicate locations along the lane 32 where the shingle material eventually will be cut by the pattern cutter 46 into individual cap shingles 51. A scoring cylinder 38 is located just upstream of the pattern cutter 46 and is rotated in a direction indicated by arrow 41. The scoring cylinder 38 is provided with scoring nibs 39 around its periphery and the scoring nibs 39 extend longitudinally along the scoring cylinder 38. The scoring cylinder 38 can be configured with a series of scoring nibs 39 spaced therealong as needed for forming one or more score lines at spaced locations across the shingle material. Each time one of the scoring nibs 39 engages the bottom of the shingle material (e.g., ribbon 34), it presses partially into, but not completely through, the shingle material to emboss a score line 44 across the lane. An anvil cylinder 42 may be provided below the scoring cylinder 38 on the other side of the lane to provide support for the shingle material during the scoring process. Each score line 44 is formed between locations 37 where the lane of shingle material will be cut by the pattern cutter 46, as discussed in more detail below.

Immediately after being scored by the scoring cylinder 38, the lane of shingle material encounters the pattern cutter 46. The pattern cutter 46, rotating in direction 48, has blades 47 around its outer surface. A platen roller 49 may be located below the pattern cutter for support and assistance in the cutting process. Each time a blade 47 engages the lane of shingle material 32, the lane is cut completely through to form the individual cap shingles 51, which are subsequently stacked and bundled. Since the cuts are made at locations 37, at least some of the score lines 44 applied by the scoring cylinder 38 extend substantially precisely along the center line of each cut cap shingle.

To ensure a substantially precise location of the score lines 44, the scoring cylinder 38 is synchronized with the pattern cutter 46. Such synchronization can be accomplished in any appropriate way. For example, the scoring cylinder 38 and the pattern cutter 46 may be mechanically coupled through a chain or belt so that they rotate together at the same rate or can be rotated at different rates. For example, in embodiments, the scoring cylinder 38 and the pattern cutter 46 can be rotated so that the cuts from the scoring cylinder 38 are substantially consistently located relative to the cutting pattern provided by the pattern cutter 46. The two cylinders could be the same size rotating at the same rate or perhaps cylinder 38 could be half of the circumference rotating at 2× the rate of cylinder 46. In embodiments, greater or lesser rotation rates also can be used.

Alternatively, one or both of the scoring cylinder 38 and the pattern cutter 46 may be driven by a controllable motor (or motors) such as a servo motor. The servo motor or motors in turn may be controlled by a computer based controller so that their rotation rates are synchronized to obtain the desired result. This technique provides an advantage of real time adjustability to maintain a substantially precise alignment of the score lines on the resulting cap shingles 51.

The scoring cylinder 38 and pattern cutter 46 may be replaced by any other mechanism for embossing a score line and cutting the shingles. For example, the pattern cutter 46 may be a chop cutter and/or the scoring cylinder 38 may be an embossing press. Further, the score line need not be pressed or embossed, but may be cut using a cutter, and need not be formed as a line, but also may be spaced dashes or dots extending at least partially through the shingle material. In some embodiments, it has been found that forming the score lines 44 immediately prior to cutting the lane of shingle material into individual shingles greatly or substantially entirely eliminates the chance that the lane of shingle material will break under lane tension when the score lines 44 are applied.

FIG. 4A generally illustrates a method and apparatus for forming individual laminated cap shingles such as shown in FIGS. 1-3. However, in some embodiments, multi-shingle strips or sheets 70 (FIG. 4B) can be formed by the method and apparatus 31 (FIG. 4A). For example, as illustrated in FIG. 4B, a multi-shingle strip can be formed from ribbons 33/34 of shingle material 30 that have been cut and laminated together as shown in FIG. 4B. The ribbons 33/34 will be moved along the processing path 36 and will be placed into registration and laminated together to form a strip or sheet 70, shown in FIG. 4B as configured with three or more shingle pieces or sections 71*a*-71*c*. In embodiments, the ribbon 33 will define a top layer 76 and ribbon 34 will define a bottom layer 73 of the individual shingles formed by each shingle section or piece 71*a*-71*c*.

Figure 5:
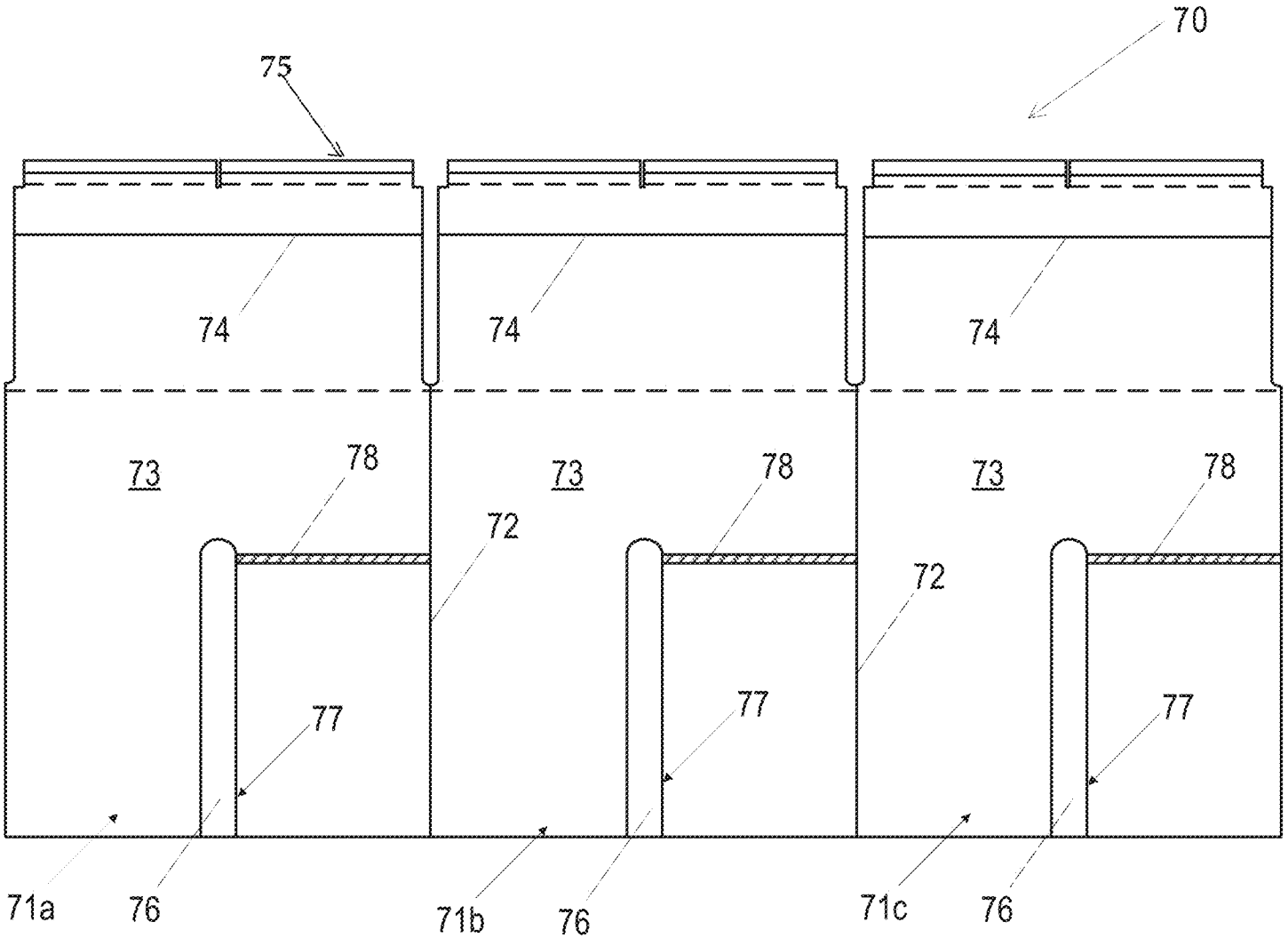
FIG. 5 is a bottom plan view of another embodiment of a laminated cap shingle according to the present disclosure.

As shown in FIG. 5, a score line or perforation 72 is defined between first and second shingle sections and between the first and second shingle sections or pieces 71*a*-71*b*, and between the second and third shingle sections or pieces 71*b*-71*c*. These score lines or perforations can be either partially or completely cut through the bottom layer of each shingle section. The score lines further can be formed across or along each shingle section of the multi-shingle strip, either as a single score line formed along each of the shingle strips or as individual score lines or space perforations. An installer in the field thereafter can separate the multi-shingle strip into sections as needed, for example, into three 12" shingle sections, by separating the shingle sections along the perforations or score lines for installation along a roof substrate.

In addition, in the method illustrated in FIG. 4B, machine direction slot 78 can be formed in the machine direction by a slitter or cutter 29*a* that can be included as part of the upstream cutter 29. This machine direction slot generally will be formed in ribbon 34 and does not create a break in the lane 32 of shingle material. This machine direction slot also does not substantially impact the lane tension upstream of the pattern cutter since it is in line with the U-shaped knife that cuts the shingle material 30 into ribbons 33/34, as a result of which the tension from this portion of the lane 32 of shingle material has already been removed. This method can be used in combination with the registered cutting cylinder located before the chop cutter, or without this additional slitter or cutter.

An adhesive (shown at 101 in FIGS. 4B and 6B) will be applied to an upper facing surface 33*a* of ribbon 33, though in some embodiments, it can be applied to the ribbon 34; after which the ribbons 33/34 are brought into registration and are adhered or laminated together to from the strip or sheet of shingle material 70. The adhesive 101 can comprise a ridge adhesive or other laminating adhesive and can be applied in dots, dashes, strips or lines.

FIG. 5 illustrates an example embodiment of a multi-shingle strip 70, which, in the example shown, includes three shingle sections or pieces 71*a*, 71*b* and 71*c*. The shingle sections each can have a construction similar to the cap shingles illustrated in FIGS. 1-2, or as illustrated in FIG. 3. Perforations or score lines 72 will be defined between the first and second shingle sections 71*a* and 71*b*, and between the second and third shingle sections 71*b* and 71*c*. As also indicated in FIG. 5, the shingle sections each generally will include a laminated, layered construction with a bottom layer 73, a headlap portion 75, and a top layer 76, which is visible through a deformation absorbing hinge or slot 77.

Figure 6B:
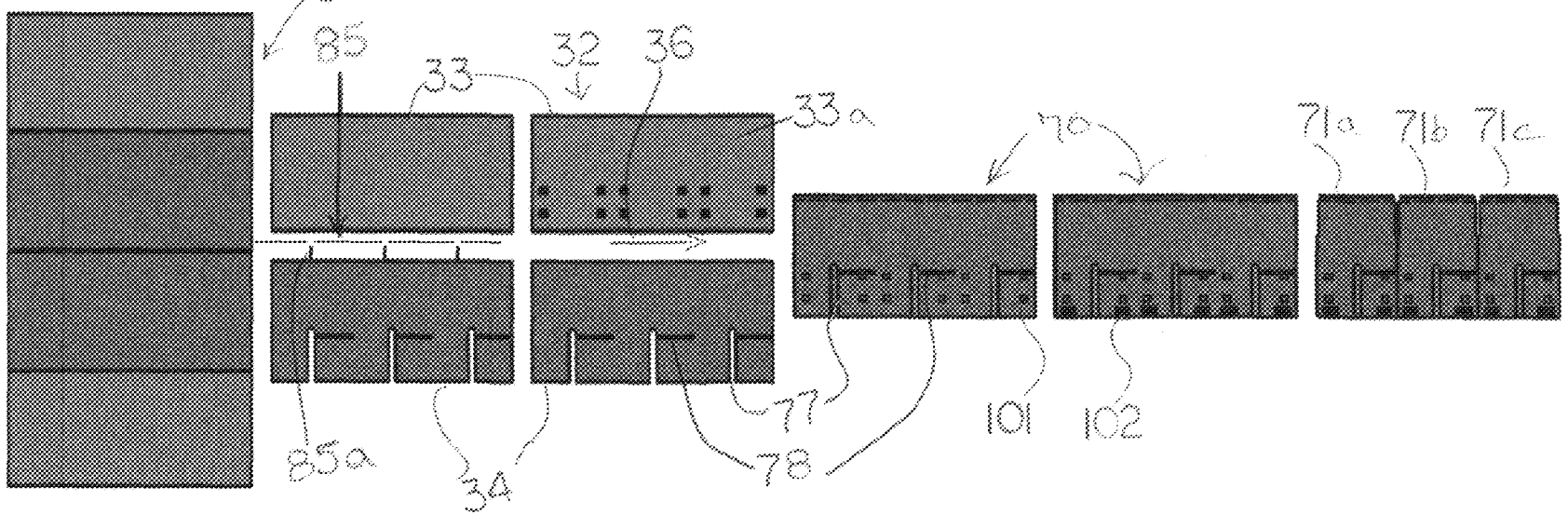
FIG. 6B is simplified schematic view illustrating another embodiment of the formation of laminated cap shingles according to principles of the present disclosure.

A self-sealing material 102 (FIGS. 4B and 6B) can be applied along or near a forward edge of the bottom layer for adhering the shingle section to the headlap portion of an adjacent, underlying cap shingle. Such self-sealing adhesive can be applied as dots, strips, lines, etc. as shown in FIGS. 4B and 6B, and can be covered with a releasable covering such as a release tape 74 (FIG. 5).

In embodiments, the deformation absorbing hinge or slot 77 formed along the bottom layer extends from the rear edge of the bottom layer to an intermediate point along the bottom layer and defines a hinge or deformation absorbing mechanism along the bottom layer. As each shingle section is bent and fitted about a hip or ridge of the roof the deformation absorbing hinge or slot 77 narrows to maintain the alignment of the side edges of the top and bottom layers of each shingle section.

An additional, machine-direction slot 78 can be formed along a portion of each shingle section 71*a*-71*c*. The machine-direction slot can be formed as a slit, score line, perforation, cut-out or similar feature and can extend completely through the bottom layer of each shingle. As indicated in FIG. 6B, this machine direction slot 78 can be formed prior to lamination of the ribbons 33/34, or in some embodiments can be formed downstream.

In embodiments, the machine-direction slot 78 further will be oriented substantially perpendicular to the deformation absorbing slot 77 or hinge, as illustrated in FIG. 5, and will be adapted to further enable flexing of the bottom layer and the formed shingle and facilitate bending of the bottom layer as the formed shingles are bent about a hip or ridge of a roof.

In addition, while each machine direction slot 78 of each shingle section is shown in FIG. 5 as extending from left to right across the bottom layers of the shingle sections and located on one side of the hinge or deformation absorbing slot 77 of the shingle section, it also will be understood by those skilled in the art that this machine direction slot 78 can be formed on either side of the hinge or deformation absorbing slot 77 of each shingle section, and/or can be formed substantially across bottom layer of each shingle section. For example, as shown in FIG. 5, the machine direction slots 78 can project at least partially into or across the hinge or deformation absorbing slot 77 of each shingle section 71*a*/71*b*/71*c*.

Still further, the deformation absorbing slot 77 is configured to facilitate ease of folding of the shingles formed by each shingle section 71*a*/71*b*/71*c* without the layers of the shingles bunching together along the exposure portions thereof. The machine direction slot 78 is configured to facilitate ease of folding of the bottom layer of each shingle section by location of the adhesive along one side of this machine direction slot 78, such that the top and bottom layers of shingle material above the machine direction 78 are enabled to slide easily across each other during folding.

As noted above, a series of adhesive strips or dots 101 (FIG. 4B) also generally will be applied between the top and bottom layers 76 and 73 of the shingle sections during operation of the methods such as shown in FIGS. 4A-4B and 6A-6B according to embodiments of the present disclosure. A registered slitting knife 29 (FIGS. 4B and 6B) further will be arranged in a position following the adhesion of the layers and proceeding the pattern, perforation, or chop cutter illustrated in FIG. 4A. The slitting knife can form the machine direction slots 78 along the bottom layer 73 of each shingle section or piece 71*a*-71*c* after the bottom layer has been adhered to the top layer 76. The registered slitting knife is adapted to slit or form a score line in the bottom layer 73 along one side thereof, between at least portion of the adhesive strips or dots applied between the layers of the multi-shingle strip, adjacent the hinge or deformation absorbing slot 77.

During installation, the machine direction slots 78 can further assist the shingle sections in flexing and bending along the hinge or deformation absorbing slot 77, helping to account for reduction in hinge flexibility due to the top and bottom layers of each shingle section being adhesively attached on both sides of the hinge or deformation absorbing slot 77, while still enabling the benefits of having the top and bottom layers of each shingle section adhered to each other on both sides of the hinge or deformation absorbing slot.

Figure 6A:
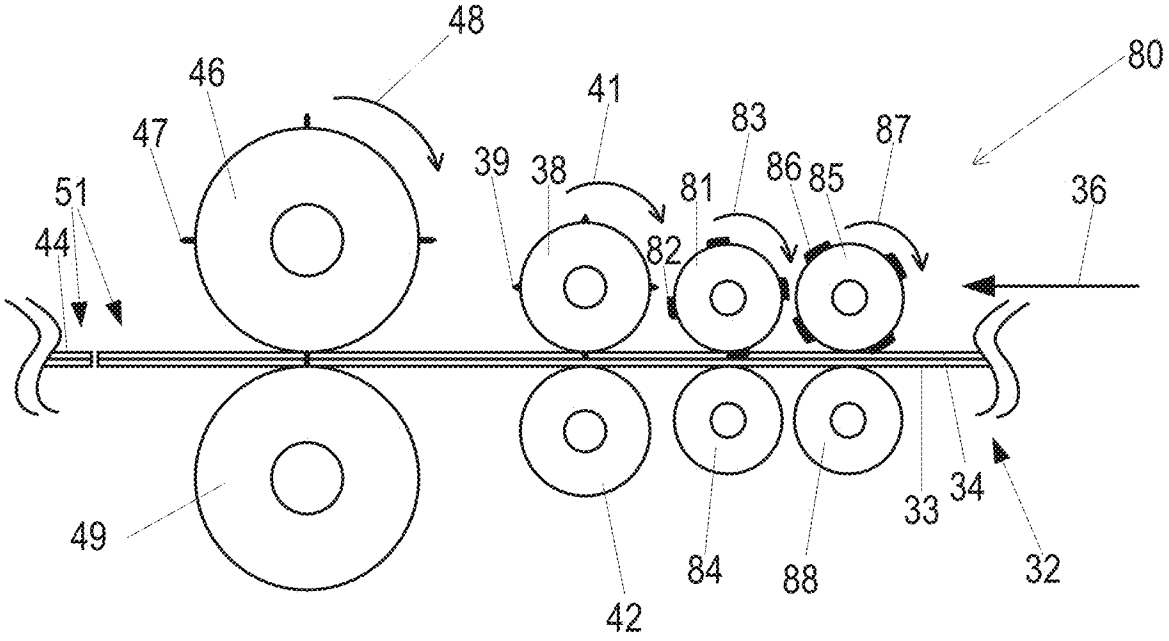
FIG. 6A is another simplified schematic view illustrating one embodiment of the method and apparatus of the present disclosure.
Figure 7:
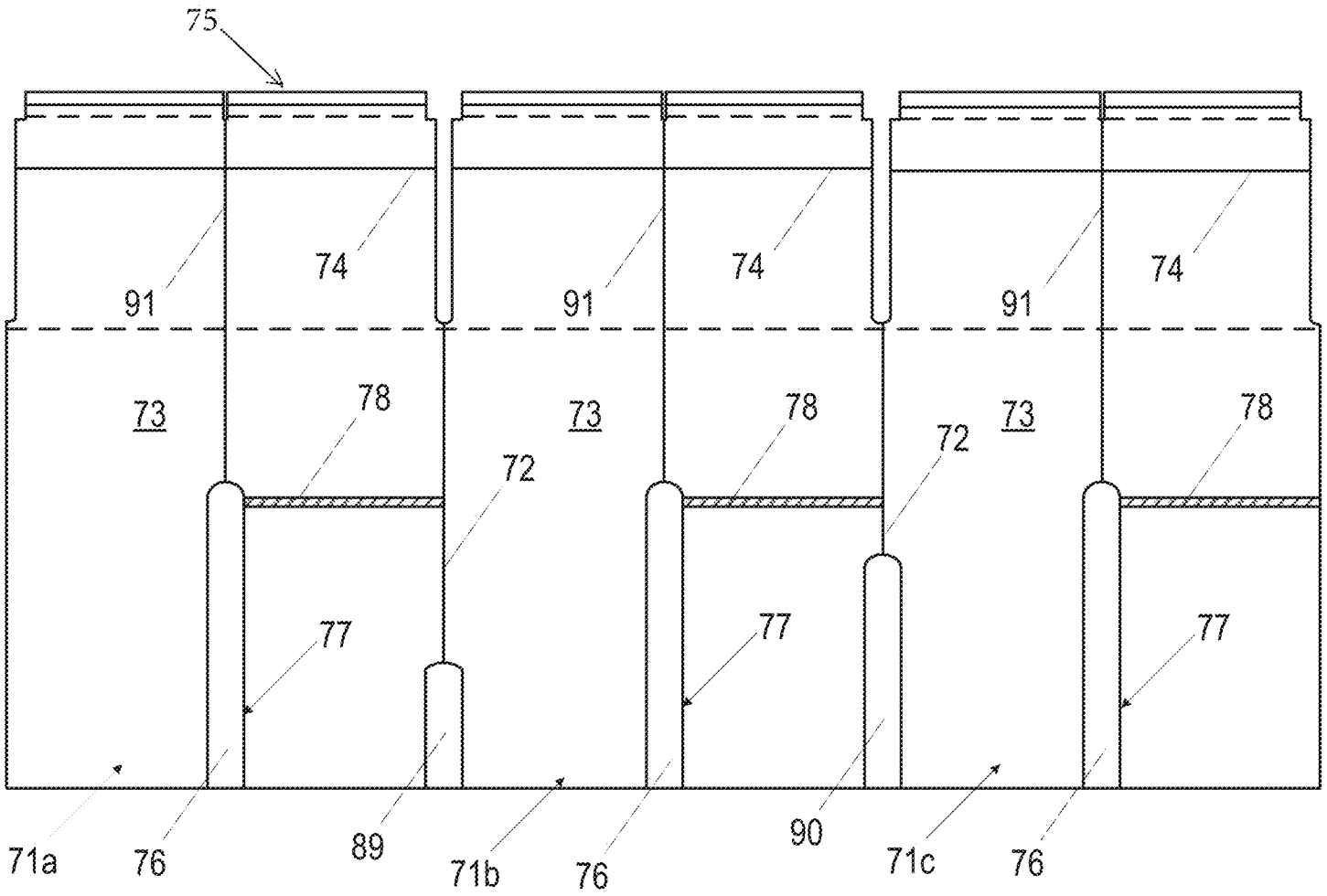
FIG. 7 is a bottom plan view of another embodiment of a laminated cap shingle according to the present disclosure.
Figure 8A:
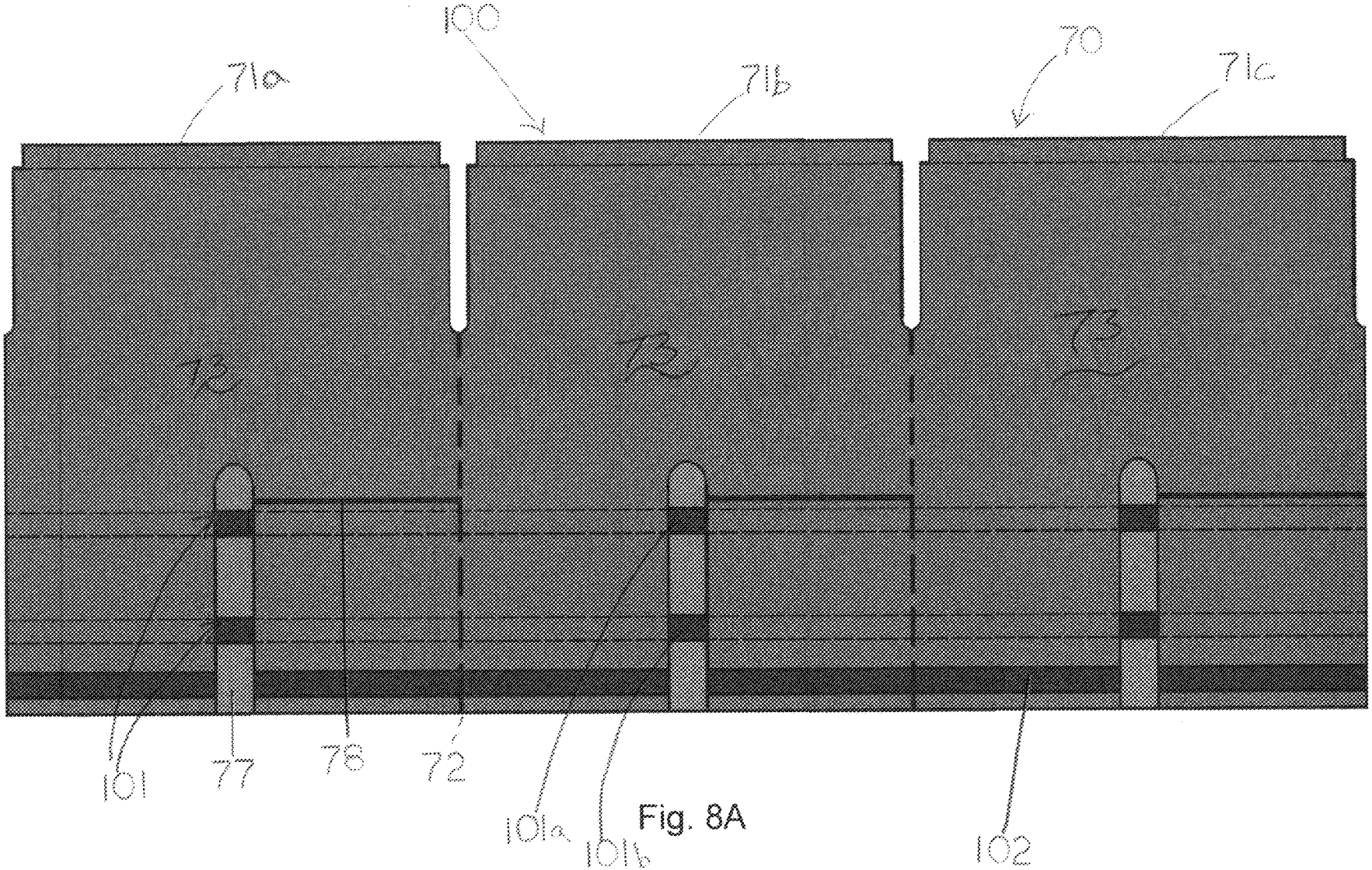
FIG. 8A is a bottom plan view of a further embodiment of a laminated cap shingle according to the present disclosure.
Figure 8B:
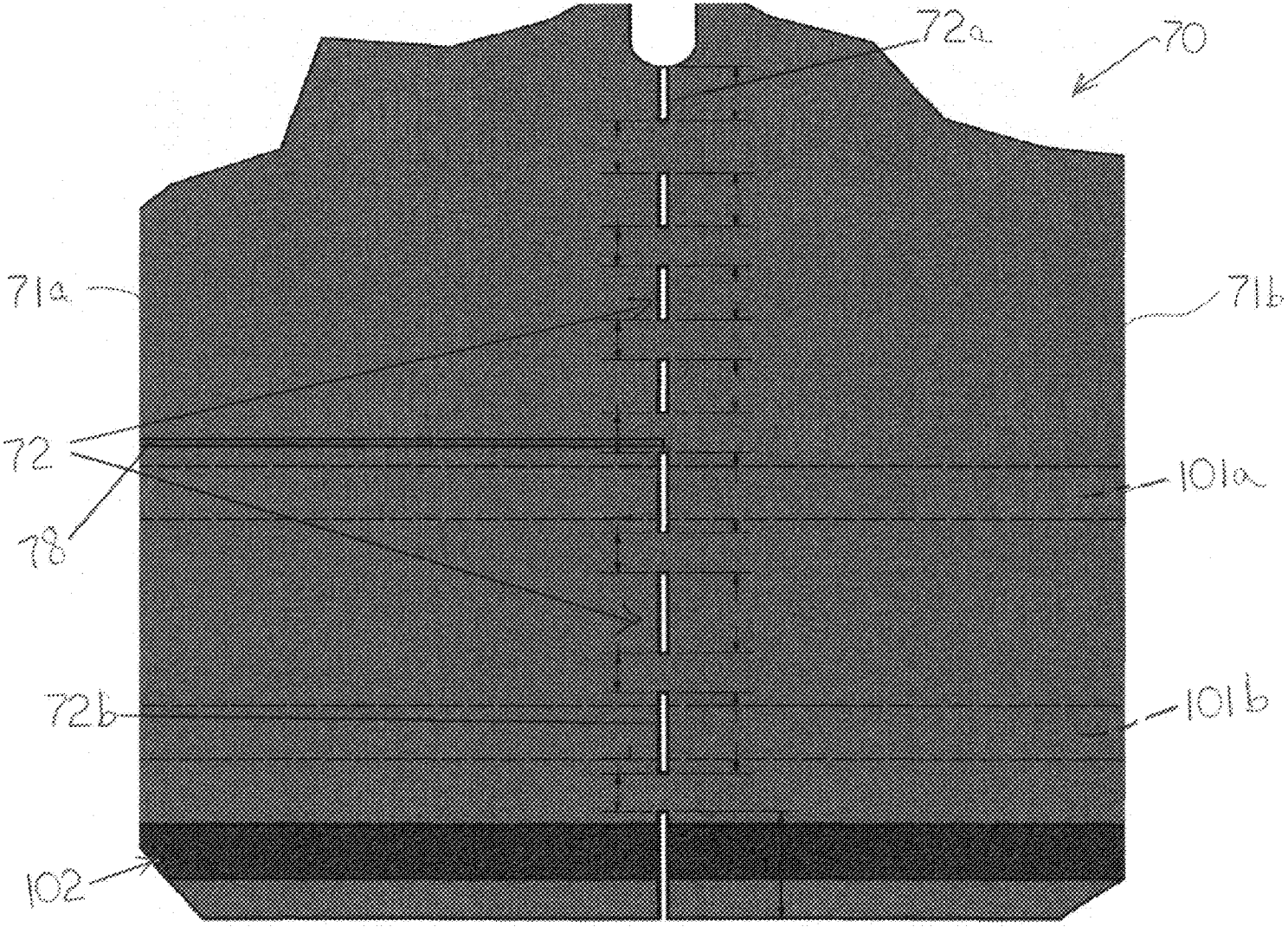
FIG. 8B is an enlarged bottom plan view of a portion of the laminated cap shingle of FIG. 8A, illustrating the perforations extending through the adhesive material applied along the cap shingles.

FIGS. 6A-6B illustrate, in simplified schematic drawings, further embodiments of a method and apparatus 80 (FIG. 6A) for forming a deformation absorbing slot 77 and a machine-direction slot 78 as shown in FIGS. 5 and 7-8B, and, for additionally forming cross-machine direction slots 89 and 90 (FIG. 7), perforations or score lines 72, and a score line 91 extending from the deformation absorbing slot 77, e.g. as shown in FIGS. 7-8B, according to principles of the present disclosure. In embodiments, neither the deformation absorbing slot 77 nor the machine direction slot 78 are formed fully through both the top and bottom layers of shingle material and thus are generally not intended to impact the ease of separating two pieces at the perforation 72.

In some embodiments, such as illustrated in FIG. 7, the cross-machine direction slots 89 and 90 can extend in substantial alignment with the perforations or score lines 72 and can help enable easier separation of the shingle sections at the perforations or score lines 72. The cross-machine direction slots further can be formed in different lengths further as shown in FIG. 7.

FIG. 6A, similar to FIG. 4A, depicts a section of a cap shingle manufacturing line near its terminal end, in which a lane of laminated shingle material 32 moving along a path of travel in direction 36 is cut into cap shingles 51 by a terminal or second pattern cutter 46. In the present embodiment, as indicated in FIG. 7, the cap shingles 51 can be formed as a strip or sheet 70 of cap shingles, including multiple (e.g. 2, 3, or more) cap shingles connected along peripheral side edge at score lines 72; and with the score lines 72 configured to facilitate separation of individual cap shingles from the strip or sheet of multiple cap shingles.

Additionally, as described above, it will be understood that before reaching this section of the manufacturing line shown in FIG. 6A, as schematically illustrated in FIG. 6B, a web of shingle material 30 generally will have been previously sliced into ribbons and at least one ribbon 34 will have been applied over and laminated to another ribbon 33 to form the lane of two-layer laminated shingle material. As illustrated, the bottom layer of the laminated shingle material (e.g., ribbon 34) faces upwardly.

In addition, as further illustrated in FIG. 6B, an adhesive 101, such as a laminating adhesive or similar adhesive material, can be applied to a first surface of ribbon 33. The adhesive can be applied as dots, dashes, lines or strips, or otherwise applied to the ribbon 33, though in some embodiments, at least a portion of the adhesive can be applied to the ribbon 34. Thereafter, the ribbons 33 and 34 can be placed into registration with ribbon 34 positioned on ribbon 33, and the ribbons laminated or adhered together to form the laminated shingle material moving along the lane of shingle material 32 with ribbon 33 generally forming the top layer 76 and ribbon 34 generally forming the bottom layer of the shingle sections 71*a*-71*c* as shown in FIG. 7.

A scoring cylinder 38 (e.g., a third cylinder or cutter as shown in FIG. 6A) is located just upstream of the pattern cutter 46 (e.g., a fourth cylinder or cutter) and is rotated in direction 41. The scoring cylinder 38 is provided with scoring nibs 39 around its periphery and the scoring nibs 39 extend longitudinally along the scoring cylinder 38. The scoring cylinder 38 can be configured with a series of scoring nibs or blades spaced thereabout as needed for forming one or more score lines at spaced locations across the shingle material. Each time one of the scoring nibs 39 engages the bottom of the shingle material (e.g., ribbon 34), one of the scoring nibs 39 presses partially into, but not completely through, the shingle material to form a score line across the lane. For example, the score line can be formed by embossing, indention, slitting or at least partially cutting into the bottom layer of shingle material. An anvil cylinder 42 may be provided below the scoring cylinder 38 on the other side of the lane to provide support for the shingle material during the scoring process (e.g., on the outwardly facing side of ribbon 33).

As illustrated in FIGS. 6B-7, each score line (e.g., score line 91 and/or perforations or score line 72) is formed between locations where the lane of shingle material will be cut by the pattern cutter 46 or, in other words, between individual cap shingles of the strip or sheet of cap shingles. Referring to FIGS. 6A and FIG. 7, the scoring cylinder 38 can provide multiple perforations or scoring lines, such as score line 91 and further can form the perforations or score line 72 (FIGS. 6A-6B) defined along the side edges of adjacent individual cap shingles of the strip or sheet of cap shingles. In some embodiments, the scoring cylinder 38 (FIG. 6A) can perforate or score the shingle material to form the score line 91 down the middle or center of the shingle material to, as described above, act as a partial hinge or fold line to help ease and direct the bending of the cap shingle when it is applied over the ridge or hip of a roof.

In other embodiments, the scoring cylinder 38 can perforate or score the shingle material to form perforations or score lines 72 (FIG. 6A) to allow ease of separation of shingles (e.g., separating shingle 71*a* from 71*b* and/or 71*b* from 71*c*). In such embodiments, the scoring cylinder 38 can include a plurality of nibs 39 set a specified distance from one another to result in a specified percentage of perforations. For example, the plurality of nibs 39 can be of varying sizes and/or can be arranged at varying spacings to increase the number of perforations and/or length of the perforations. For example, if a slit or slot of varying lengths (e.g., cross-machine direction slot 89 and 90) is cut along the bottom layer of the shingle material, or along both the bottom and top layers of the shingle material, then fewer perforations can be utilized for perforations or score lines 72, while ease of separation of shingles is maintained.

As illustrated, prior to scoring or perforation, the shingle material can encounter one or more machine direction slitting or cutting cylinders to create various cuts or slits along the bottom of the shingle material. As illustrated in FIG. 6A, two machine direction slitting or cutting cylinders 81 (e.g., a second cylinder or cutter) and 85 (e.g., a first cylinder or cutter) with blades 82 and 86 of varying sizes and patterns may create cut outs, slots, or slits in the bottom portion of the shingle material, e.g., hinge or deformation absorbing slot 77, machine-direction slot 78, cross machine-direction slots 89 and 90, and/or other slots.

The slitting or cutting cylinders 81 and 85 can be located upstream of the scoring cylinder 38 and the slitting or cutting cylinders 81 and 85 can rotate in direction 83 and 87. Platen rollers 84 and 88 corresponding to cutting cylinders 81 and 85 can be located opposite the slitting or cutting cylinders 81 and 85 on the other side of the shingle material in a position to hold or press the shingle material against the cutting cylinders 81 and 85 as the cutting cylinders engage the shingle material, e.g., the slitting or cutting cylinders 81 and 85 may be located at outwardly facing side of ribbon 34, while the platen rollers 84 and 88 may be located at the outwardly facing side of ribbon 33.

As noted, varying sizes and patterns may be utilized for the blades 82 and 86 of the slitting or cutting cylinders 81 and 85. In embodiments, the shape or pattern of the blades 82 and 86 depend on the length of the slot or slit desired for a particular application. For example, the blade 86 may be slightly longer to cut a longer slot for cross machine direction slot 90, while in another embodiment, the blade 86 may be shorter to cut a shorter cross machine direction slot 89. The length of the cross machine direction slot may depend on the amount or number of perforations along perforations or score lines 72. In another embodiment, rather than including scoring cylinder 38 and/or the slitting or cutting cylinders 81 and 85, one scoring, slitting, or cutting cylinder may be included with a plurality of blades arranged in a pattern configured to form the perforations, score lines, slits, and/or slots illustrated in FIG. 7, as well as any different or additional number of slots or perforations.

Immediately after being scored by the scoring cylinder 38 (FIG. 6A), the lane of shingle material encounters the pattern cutter 46, the pattern cutter 46 to cut the shingles completely through, as described above. Further, as described above, to ensure substantial precision in location of the score lines 44, the scoring cylinder 38 is synchronized with the pattern cutter 46 and other cutters. Such synchronization can be accomplished in any appropriate way. For example, the scoring cylinder 38, slitting or cutting cylinders 81 and 85, and/or the pattern cutter 46 may be mechanically coupled through a chain or belt so that they rotate together at the same rate, or can be rotated at different rates.

Alternatively, one or more of the scoring cylinder 38, slitting or cutting cylinders 81 and 85, and/or the pattern cutter 46 may be driven by a controllable motor such as a servo motor. The servo motor or motors in turn may be controlled by a computer based controller so that their rotation rates are synchronized and operated to obtain the desired result. This technique provides the advantage of real time adjustability to maintain the desired precise alignment of the perforations, score lines, slits, and/or slots on the resulting cap shingles 51.

In other embodiments, the scoring cylinder 38, slitting or cutting cylinders 81 and 85, and/or the pattern cutter 46 may be replaced by any other and/or any number of mechanisms for embossing a score line, forming or creating slits, slots, or cutouts in the shingles, and/or cutting the shingles. To ensure that the shingle material does not break under lane tension when either score lines, perforations, slits, slots and/or cuts are applied, such an application may be performed immediately prior to cutting the lane of shingle material into individual shingles, thus substantially or entirely eliminating the chance that the lane of shingle material will break under lane tension.

In yet another embodiment, the apparatus 80 may include any number of cylinders or cutters, depending on the desired amount and types of cuts, slits, slots, and/or perforations. The apparatus 80 may include a first cylinder, a second cylinder, a third cylinder, a fourth cylinder, and/or other cylinders to cut various slots and/or patterns in the shingle material. The first cylinder may correspond to slitting or cutting cylinder 85, the second cylinder may correspond to slitting or cutting cylinder 81, the third cylinder may correspond to scoring cylinder 38, and the fourth cylinder may correspond to the pattern cutter 46.

While the cylinders generally are illustrated as operating after lamination of ribbon 34 and ribbon 33, it will be understood that a portion of the cylinders may operate prior to lamination of ribbon 34 to ribbon 33. For example, the first cylinder (e.g., slitting or cutting cylinder 85) generally will cut the shingle material to form the deformation absorbing slot 77 prior to the lamination of ribbon 34 and ribbon 33. In embodiments, the first cylinder (e.g. slitting or cutting cylinder 85) also can be used to form the machine direction slot 78, which can be formed by the cutting cylinder before lamination (e.g. by the first cylinder 85), such as indicated in FIG. 6B. In other embodiments, the machine direction slot could be formed after lamination by a downstream cutting cylinder. Other cylinders or cutters may be included for other purposes, for example to cut the shingle material into ribbon 34 and ribbon 33.

FIGS. 8A and 8B illustrate a further embodiment of a laminated cap shingle 100 including an adhesive 101, such as e.g. a ridge adhesive or laminating adhesive, applied as one or more lines of adhesive (shown as dashed lines 101*a*/101*b*) extending along a first surface 33*a* of a ribbon of shingle material 33, for adhering and laminating the ribbons 33 and 34 of shingle material together to form a strip or sheet 70 of shingle material, with ribbon 33 defining a top layer 76 ribbon 34 defining a bottom layer 73 of the shingle material. A sealant material 102 further will be applied in a line along a lower edge of a bottom surface of the bottom layer 73. In the embodiment illustrated in FIG. 8A, the multi-shingle section or strip 70 is shown with a series of 3 shingle sections or pieces 71*a*-71*c*; but it will be understood that additional shingle sections or pieces also can be formed as part of the multi-shingle section or strip 70.

As further illustrated in FIGS. 8A and 8B, in the present embodiment, the adhesive 101 and sealant material 102 are applied as substantially continuous lines or strips, rather than registered dots or dashes such as shown in FIGS. 4B and 6B. The use of substantially continuous lines of adhesive and sealant material can help reduce or eliminate the need for registration of the placement of adhesive dots or dashes or other patterns of adhesive and sealant material relative to the chop cutter (e.g. cutting cylinder 46 as shown in FIGS. 4A and 6A). This can help increase run rates, lower processing costs and further help provide better adhesion between the ribbons or layers of laminated shingle material as well facilitate better adhesion and sealing of the laminated cap shingles upon installation thereof about of over ridge, hip, or rake of a roof.

With the application of the substantially continuous lines of adhesive and sealant material, the cutting blades of the slitting or cutting the cylinders (e.g. nibs 39 of scoring cylinder 38 and blades 82 and 86 of the slitting or cutting cylinders 81 and 85 shown in FIG. 6A) can be arranged or located so as to cut through the lines of adhesive 101*a*/101*b* and sealant material 102 as indicated in FIGS. 8A and 8B. For example, as shown in FIG. 8A, the sealant material 102 can be cut and thus will stop on each side edge of the deformation absorbing slot 77, defining a gap where the hinge or deformation absorbing slot is located. In embodiments, however, the lines of adhesive 101*a*/101*b*, generally will extend substantially continuously across the deformation absorbing slot, such as shown in FIG. 8A. In other embodiments, the lines of adhesive also can stop and/or be cut away from the deformation absorbing slot or hinge 77.

As further illustrated in FIG. 8B, the perforation or score lines 72 for separation of the shingle sections 71*a*-71*c* further generally will be formed to depth or extent so as to cut through lines of adhesive 101*a*/101*b* and the lines of sealant material 102. The perforations or score lines 72 further can be formed with different lengths, including, being of a smaller length at or along the upper portion of each of the shingle sections, and increasing in length with the bottom of the shingle sections so as to substantially overlap and be formed through the lines of ridge adhesive and the sealant material (as indicated in FIG. 8B).

For example, in embodiments, the upper score lines or perforations 72*b* can extend for a length or distance of 0.25 inches to 0.7 inches, 0.25 inches to 0.65 inches, 0.25 inches to 0.6 inches, 0.25 inches to 0.5 inches, 0.25 inches to 0.45 inches, 0.25 inches to 0.4 inches, 0.25 inches to 0.35 inches, 0.25 inches to 0.3 inches, 0.3 inches to 0.7 inches, 0.3 inches to 0.65 inches, 0.3 inches to 0.6 inches, 0.3 inches to 0.55 inches, 0.3 inches to 0.5 inches, 0.3 inches to 0.45 inches, 0.3 inches to 0.4 inches, 0.3 inches to 0.35 inches, 0.4 inches to 0.7 inches, 0.4 inches to 0.65 inches, 0.4 inches to 0.6 inches, 0.4 inches to 0.55 inches, 0.4 inches to 0.5 inches, 0.4 inches to 0.45 inches, 0.45 inches to 0.7 inches, 45 inches to 0.65 inches, 0.45 inches to 0.6 inches, 0.45 inches to 0.55 inches, 0.45 inches to 0.5 inches, 0.5 inches to 0.7 inches, 0.5 inches to 0.65 inches, 0.5 inches to 0.6 inches, 0.5 inches to 0.55 inches, 0.55 inches to 0.7 inches, 0.55 inches to 0.65 inches, 0.55 inches to 0.6 inches, or 0.6 inches to 0.7 inches. In some embodiments, the upper slits 72A will be 0.5 inches in length, though greater or lesser lengths also can be used.

The lower perforations or score lines 72*b* can be of a greater length or extend for a greater distance than the upper score lines 72*a*. For example, the lower score lines can be 0.75 inches in length, and in embodiments, can extend for a length of 0.5 inches to 1.0 inch, 0.5 inches to 0.9 inches, 0.5 inches to 0.8 inches, 0.5 inches to 0.7 inches, 0.5 inches to 0.6 inches, 0.6 inches to 1.0 inch, 0.6 inches to 0.9 inches, 0.6 inches to 0.8 inches, 0.6 inches to 0.7 inches, 0.7 inches to 1.0 inch, 0.7 inches to 0.9 inches, 0.7 inches to 0.8 inches, 0.8 inches to 1.0 inch, 0.8 to 0.9 inches, or 0.9 inches to 1.0 inch. Other, greater or lesser lengths or distances of the perforations of score lines also can be used.

For example, as also illustrated in FIG. 8B, the score line or perforation line that extends through the line of sealant material 102 further can be of an extended or greater length, e.g., extending 0.7 inches to 1.0 inch, 0.75 inches to 0.95 inches, 0.75 inches to 0.9 inches, 0.75 inches to 0.85 inches, 0.75 inches to 0.8 inches, 0.8 inches to 1.0 inch, 0.8 inches to 0.95 inches, 0.8 inches to 0.9 inches, 0.8 inches to 0.85 inches, 0.85 inches to 1.0 inch, 0.85 inches to 0.95 inches, 0.85 inches to 0.9 inches, 0.9 inches to 1.0 inch, 0.9 inches to 0.95 inches, or 0.95 inches to 1.0 inch. Other varying lengths of the score lines or perforations also can be used.

The perforations or score lines also can be formed in the multi-shingle strips or sheets 70 while the adhesive and sealant materials generally in a heated or substantially semi-liquid state. The perforations or score lines further generally will extend all the way through the adhesive lines and the sealant material so that the adhesive material does not hinder separation of the shingle sections 71*a*-71*c* in the field. In addition, application of the additional adhesive in the lines of formed substantially continuous line of adhesive can assist in the separation of the shingle sections along the perforations or score lines since the full adhesion of the ribbons or layers of shingle material can help prevent buckling of the layers within a ridge piece, as separation at the perforation or score lines should not affect the rest of the shingle section.

The present disclosure has been described herein within the context of certain examples that embody principles of the present disclosure. It will be understood by the skilled artisan, however, that a wide gamut of additions, deletions, and modifications, both subtle and gross, might well be made to the illustrative examples without departing from the spirit and scope of the present disclosure. For example, the present disclosure has been described primarily as being applied to multi-layer laminated cap shingles. However, the method and apparatus also may be applied to single layer cap shingles with the score lines being embossed partially through the material on the backs of the shingles. The methodology also can greatly reduce or eliminate lane breakage in the manufacturing of single layer cap shingles as well as laminated cap shingles. These and other modifications may be made by those of skill in the art without departing from the full scope of the present disclosure.

The invention claimed is:

1. A roof structure, comprising:

a hip or ridge;

a plurality of cap shingles positioned along the hip or ridge, each cap shingle of the plurality of cap shingles comprising:

(1) two separate layers of shingle material, wherein the layers include:

(i) a top layer formed from a first web of shingle material comprising:

an exposure portion; and a headlap portion configured to connect to an adjacent cap shingle along the hip or ridge; and (ii) a bottom layer formed from a second web of shingle material and positioned along a lower surface of the top layer, the bottom layer comprising:

at least one score line at least partially extending through the bottom layer; and a slot in the bottom layer beginning at a forward edge of the bottom layer and extending toward the headlap portion; and (2) an adhesive material applied between the top and bottom layers so as to adhere the top layer to the bottom layer;

wherein the slot is configured to facilitate bending of the bottom layer as the cap shingle is positioned over the hip or ridge with the bottom layer remaining adhered to the top layer.

2. The roof structure of claim 1, wherein the at least one score line extends through the headlap portion from the slot to an upper edge of each cap shingle, and is configured to further facilitate bending of the bottom layer as the cap shingle is fitted over the hip or ridge.

3. The roof structure of claim 1, wherein the cap shingles comprise a sheet of cap shingles including multiple cap shingles, and wherein the at least one score line comprises a plurality of score lines defined along the sheet of cap shingles and configured to facilitate separation of the multiple cap shingles into individual cap shingles.

4. The roof structure of claim 3, wherein the cap shingles of the sheet of cap shingles further comprise a machine direction slot configured to facilitate bending of the bottom layer of each of the individual cap shingles and a cross-machine direction slot configured to further facilitate separation of one individual cap shingle from another cap shingle of the sheet of cap shingles.

5. The roof structure of claim 1, further comprising a self-sealing material applied along at least a portion of the bottom layer of each cap shingle adjacent a forward end thereof, the self-sealing material configured to attach the bottom layer of each cap shingle to a headlap portion of an adjacent cap shingle positioned along the hip or ridge.

6. The roof structure of claim 1, wherein the bottom layer further comprises a machine direction slot formed perpendicular to the slot and configured to further facilitate bending of the bottom layer.

7. The roof structure of claim 1, wherein the at least one score line of each cap shingle is formed along a center line of the cap shingle, beginning at a rear edge of the bottom layer.

8. A roof structure, comprising:

a hip or ridge;

a plurality of cap shingles positioned along the hip or ridge, each cap shingle of the plurality of cap shingles comprising:

(1) two separate layers of shingle material, including:

(i) a top layer formed from a first web of shingle material and comprising:

an exposure portion; and a headlap portion configured to attach to an adjacent cap shingle along the hip or ridge;

(ii) a bottom layer formed from a second web of shingle material and positioned along a lower surface of the top layer, the bottom layer comprising:

at least one score line at least partially extending through the bottom layer; and a slot formed in the bottom layer beginning at a forward edge of the bottom layer and extending to an intermediate point along the bottom layer; and (2) an adhesive material applied between the top and bottom layers so as to adhere the top layer to the bottom layer;

wherein the slot is formed through the bottom layer such that a portion of the top layer is exposed therethrough;

wherein the slot is configured to facilitate bending of the bottom layer as the cap shingle is positioned over the hip or ridge with the bottom layer remaining adhered to the top layer.

9. The roof structure of claim 8, wherein the at least one score line extends from the slot to an upper edge of each cap shingle, and is configured to further facilitate bending of the bottom layer as the cap shingle is fitted over the hip or ridge.

10. The roof structure of claim 8, wherein the bottom layer further comprises a machine direction slot formed perpendicular to the slot and configured to further facilitate bending of the bottom layer.

11. The roof structure of claim 8, wherein the at least one score line of each cap shingle is formed along a center line of the cap shingle, beginning at a rear edge of the bottom layer.

12. The roof structure of claim 8, wherein the cap shingles comprise a sheet of cap shingles including multiple cap shingles, and wherein the at least one score line further comprises a plurality of score lines defined along the sheet of cap shingles and configured to facilitate separation of the multiple cap shingles into individual cap shingles.

13. The roof structure of claim 8, further comprising a self-sealing material applied along at least a portion of the bottom layer of each cap shingle adjacent a forward end thereof, the self-sealing material configured to attach the bottom layer of each cap shingle to a headlap portion of an adjacent cap shingle positioned along the hip or ridge.

* * * * *